US006923364B2

(12) United States Patent
Burkholder et al.

(10) Patent No.: US 6,923,364 B2
(45) Date of Patent: Aug. 2, 2005

(54) METHOD FOR MANUFACTURING AIR COMPRESSOR ASSEMBLY

(75) Inventors: Robert F. Burkholder, Jackson, TN (US); Scott Curnel, Jackson, TN (US); Mark W. Wood, Jackson, TN (US); Matt Wright, Jackson, TN (US); David W. Robenalt, Jackson, TN (US); Kurt Russell, Henderson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 215 days.

(21) Appl. No.: 10/600,040

(22) Filed: Jun. 20, 2003

(65) Prior Publication Data

US 2004/0047740 A1 Mar. 11, 2004

Related U.S. Application Data

(60) Provisional application No. 60/408,860, filed on Sep. 6, 2002.

(51) Int. Cl.[7] ..... B23K 28/00
(52) U.S. Cl. ..... 228/200; 228/202; 228/214
(58) Field of Search ..... 228/200, 202, 228/214

(56) References Cited

U.S. PATENT DOCUMENTS 4,722,673 A * 2/1988 Grime et al. ..... 417/360
4,828,131 A * 5/1989 Strubel ..... 222/464.7
5,054,740 A * 10/1991 Wheeler ..... 248/675
6,102,679 A * 8/2000 Brown ..... 417/550
6,742,995 B1 * 6/2004 Wood et al. ..... 417/234
6,770,177 B2 * 8/2004 Keller et al. ..... 204/196.37
2003/0085117 A1 * 5/2003 Keller et al. ..... 204/196.07
2003/0180156 A1 * 9/2003 Brashears et al. ..... 417/234
2004/0028535 A1 * 2/2004 Brashears et al. ..... 417/234
2004/0047740 A1 * 3/2004 Burkholder et al. ..... 417/53
2004/0175276 A1 * 9/2004 Downes ..... 417/234
2004/0197200 A1 * 10/2004 Wood et al. ..... 417/234

* cited by examiner

*Primary Examiner*—Kiley S. Stoner
(74) *Attorney, Agent, or Firm*—Suiter West Swantz pc llo

(57) ABSTRACT

A method for manufacturing an air compressor assembly including, between a tank welding step and a final assembling step, a step of submerging a welded tank into a dip tank that contains cooling liquid treated with a corrosion inhibitor. In a preferred embodiment, in the submerging step, all air access ports of the welded tank are open to allow the cooling liquid to coat both the inside and outside surfaces of the air tank to maximize corrosion inhibitor protection and increase tank cooling rate. The method for manufacturing an air compressor assembly according to the present invention may be used in manufacturing air compressor assemblies in various styles.

19 Claims, 11 Drawing Sheets

METHOD FOR MANUFACTURING AIR COMPRESSOR ASSEMBLY

CROSS-REFERENCE TO RELATED DOCUMENTS

The present application claims the benefit under 35 U.S.C. § 119(e) of U.S. Provisional Application Ser. No. 60/408,860, filed Sep. 6, 2002. Said U.S. Provisional Application Ser. No. 60/408,860 is herein incorporated by reference in its entirety.

The present application herein incorporates the following United States Patent Applications by reference in their entirety:

| Attorney Docket Number | "Express Mail" Mailing Label No. | Filing Date |
|---|---|---|
| PTG 02-96-2 | EV 338 284 628 US | Jun. 20, 2003 |
| PTG 02-96-3 | EV 338 284 614 US | Jun. 20, 2003 |

FIELD OF THE INVENTION

The present invention relates generally to the field of air compressors, and particularly to a method for manufacturing an air compressor assembly.

BACKGROUND OF THE INVENTION

Manufacturing an air compressor assembly is a time consuming and expensive process. It conventionally requires the use of several manufacturing cells. For example, air compressors and motors may be built and assembled in one cell, and air tanks may be welded and fabricated in a separate cell. One way to reduce size and capital expense and to improve the efficiency of the manufacturing cells is to include air tank welding and fabrication and final assembly of the air compressor assembly in a single cell. However, after welding, the air tank is typically too hot to allow assemblers to begin final assembly. This may greatly decrease the manufacturing efficiency. Moreover, the welding process may reduce the corrosion resistance of the air tank metal in the heat-affected zones of the tank, adversely affecting the quality of the air tank.

Thus, it would be desirable to provide a method for manufacturing an air compressor assembly that enhances both the manufacturing efficiency and the air tank quality.

SUMMARY OF THE INVENTION

Accordingly, the present invention is directed to a method for manufacturing an air compressor assembly. In one aspect of the present invention, the method includes a step of submerging a welded air tank into a dip tank that contains cooling liquid treated with a corrosion inhibitor between a step of tank welding and a step of final assembling. In a preferred embodiment, in the submerging step, all air access ports of the welded tank are open to allow cooling liquid to coat both the inside and outside surfaces to maximize corrosion inhibitor protection and increase tank cooling rate.

The method for manufacturing an air compressor assembly according to the present invention may be used in manufacturing air compressor assemblies in various styles, including a portable air compressor assembly, a "pancake" type air compressor assembly, a "hot-dog" type air compressor assembly, a vertical "hot-dog" type air compressor assembly, a "double hot-dog" type air compressor assembly, a vertical stationary type air compressor assembly, and the like.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
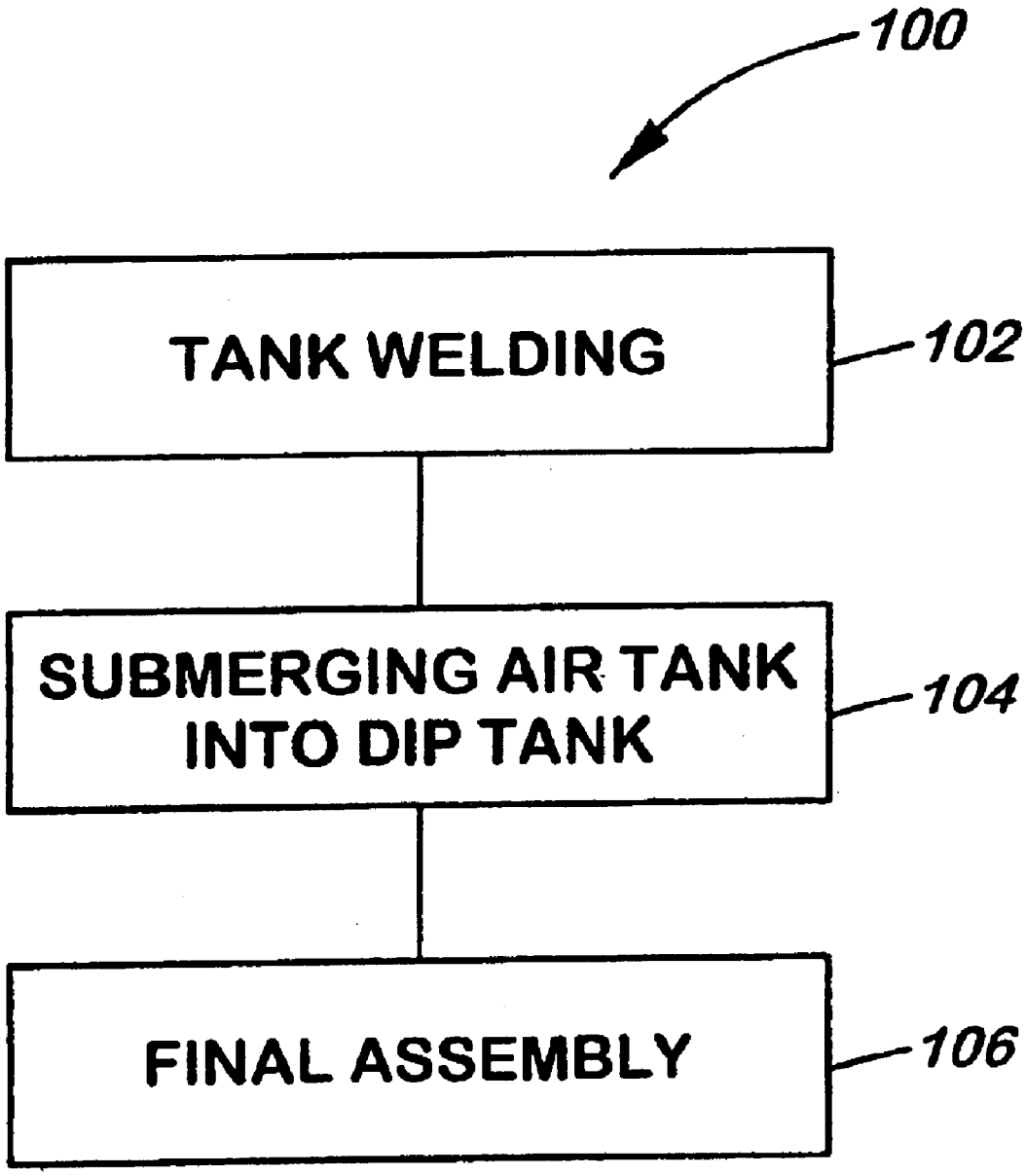
FIG. 1 is a flow chart illustrating an exemplary method for manufacturing an air compressor assembly in accordance with the present invention.

Referring to FIG. 1, a flow chart illustrating an exemplary method 100 for manufacturing an air compressor assembly in accordance with the present invention is shown. The method 100 starts with step 102, in which an air tank is welded. Typically, after welding the air tank is too hot to allow assembly handlers to begin final assembly. Additionally, the welding process may reduce the corrosion resistance of the tank metal (e.g., steel) in the heat-affected zones of the tank. To solve these problems, in step 104 the welded air tank is submerged into a dip tank which contains cooling liquid (e.g., water) treated with a corrosion inhibitor. In a preferred embodiment, the welded air tank is submerged into the dip tank with all air access ports open to allow cooling liquid to coat both the inside and outside surfaces to maximize corrosion inhibitor protection and increase tank cooling rate. Next, in step 106, the air tank is assembled into a final product. It is understood that any step of the method 100 may be performed by a human being, a robot, or the like without departing from the scope and spirit of the present invention.

According to the present invention, the method 100 may be applied to air compressor assemblies in various styles, including a portable air compressor assembly, a "pancake" type air compressor assembly, a "hot-dog" type air compressor assembly, a vertical "hot-dog" type air compressor assembly, a "double hot-dog" type air compressor assembly, a vertical stationary type air compressor assembly, and the like.

Referring generally now to FIGS. 2 through 5, an exemplary embodiment of the method 100 applied to manufacturing a portable air compressor assembly 300 (see FIGS. 4 and 5) in accordance with the present invention is shown. As shown in FIG. 2A, a worker 202 is welding an air tank 204 in accordance with an exemplary embodiment of the welding step 102 illustrated in FIG. 1. The worker 202 may be a human being, a robot, or the like. The air tank 204 may have two air access ports 210 which are located at the tank wall. The air access ports 210 are openings that extend through the wall of the air tank 204. The air tank 204 may be made of metal such as steel, or the like.

Figure 2A:
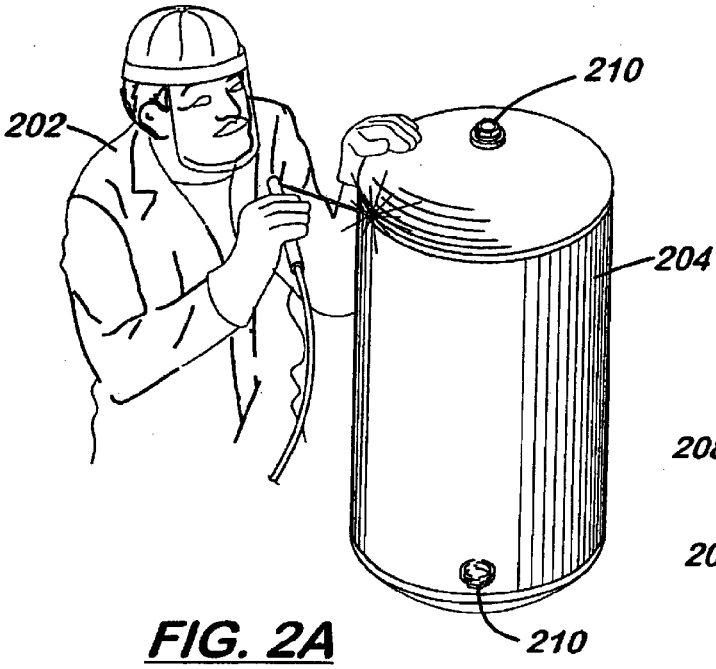
FIG. 2A depicts an exemplary embodiment of an air tank of a portable air compressor assembly in a welding step in accordance with an exemplary method of the present invention.
Figure 2B:
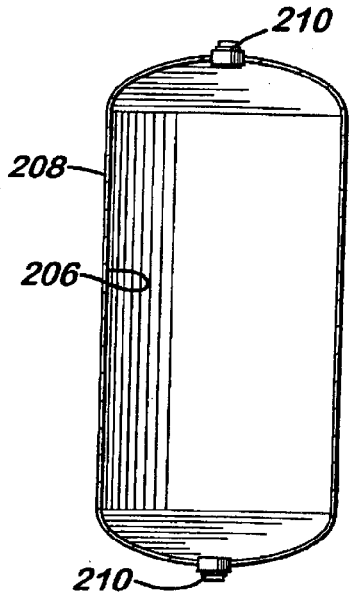
FIG. 2B is a cross-sectional side elevation view illustrating the air tank shown in FIG. 2A.

FIG. 2B is a cross-sectional side elevation view illustrating the air tank 204 shown in FIG. 2A. The air tank 204 has an inside surface 206, an outside surface 208 and the air access ports 210. Through the air access ports 210, during the utilization of the portable air compressor assembly 300, compressed air may be provided to the air tank 204 by an air compressor 232 (not shown in FIG. 2B, but shown in FIG. 4) or taken out of the air tank 204 for use in air powered tools (not shown). Air access ports 210 may also be used to drain condensed moisture accumulated inside the air tank 204. After the worker 202 finished the welding step 102, the air tank 204 is typically too hot to allow it to be finally assembled. This may greatly decrease manufacturing efficiency. Moreover, the welding step 102 shown in FIG. 2A may reduce the corrosion resistance of the air tank metal in the heat-affected zones of the air tank 204, adversely affecting the quality of the air tank 204. Thus, in the same cell for the tank welding step, a dip tank is added.

Figure 3:
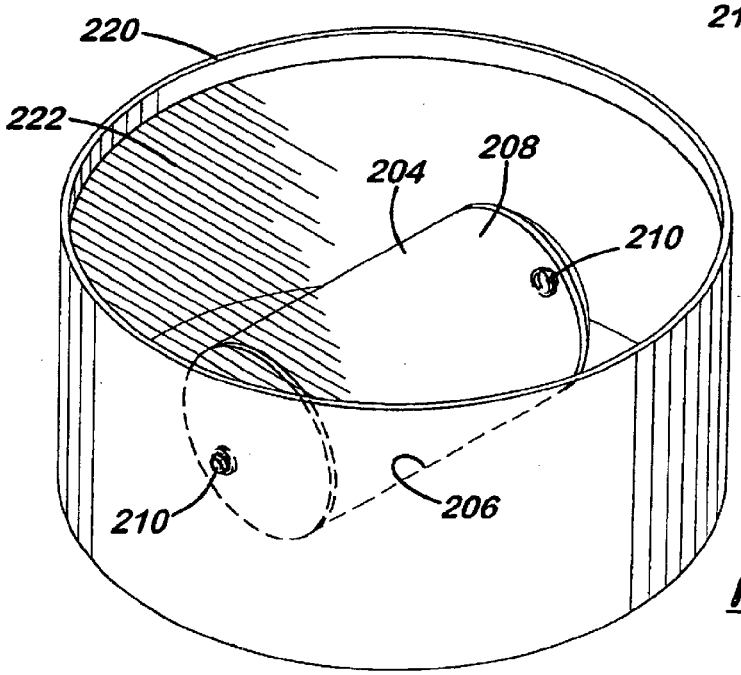
FIG. 3 illustrates the air tank depicted in FIGS. 2A and 2B in a submerging step in accordance with an exemplary method of the present invention.

Referring to FIG. 3, an exemplary embodiment of the submerging step 104 illustrated in FIG. 1 is depicted. A dip tank 220 is filled with cooling liquid (e.g., water) 222 treated with a corrosion inhibitor. After the worker 202 finished the welding step, the air tank 204 is fully submerged into the dip tank 220 to cool down and gain corrosion inhibitor protection. The submerging step may be performed by a human being, a robot, or the like. In one preferred embodiment, the air tank 204 is submerged into the dip tank 220 with its air access ports 210 open to allow cooling liquid 222 to coat both the inside surface 206 and the outside surface 208 to maximize corrosion inhibitor protection and increase tank cooling rate. After the submerging step 102 is finished, the air tank 204 may be air dried and then be ready for final assembly.

Figure 4:
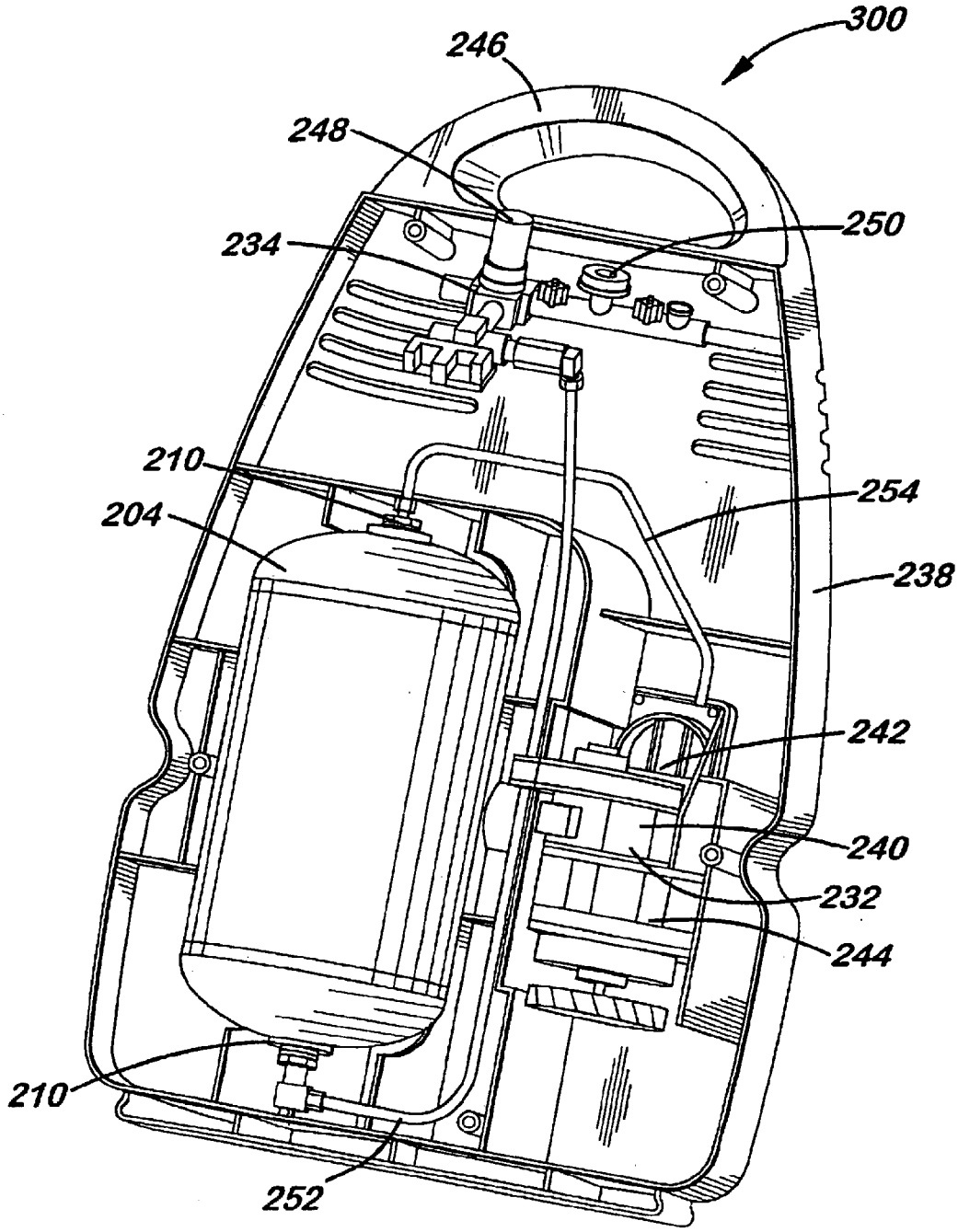
FIG. 4 depicts the air tank shown in FIGS. 2A, 2B and 3 in the portable air compressor assembly in a final assembly step in accordance with an exemplary method of the present invention.

Referring now to FIG. 4, an exemplary embodiment of the final assembly step 106 shown in FIG. 1 is depicted. The portable air compressor assembly 300 is assembled by a human being and/or a robot (not shown) in the same cell for the welding step and the dip tank. The portable air compressor assembly 300 may include the air tank 204, the air compressor 232, and a manifold assembly 234 assembled within a shroud or housing 238. The air compressor 232 may include a compressor 240 having one or more pistons 242 driven by a motor or engine 244. For example, the air compressor 232 may include a single piston compressor 240 having a single piston driven by a universal electric motor 244. By employing a universal electric motor 244, the speed at which the motor 244 operates, and thus the speed at which the piston 242 is reciprocated, may be varied by controlling the voltage supplied to the motor 244. In this manner, the air flow rate supplied by the air compressor 232 to the air tank 204 may be varied. For example, in the embodiment illustrated in FIG. 5, a speed control switch 256 is provided, which allows an operator to select between a high speed step mode wherein maximum air flow is supplied to the air tank 204 and a low speed operating mode wherein the compressor 240 runs more slowly reducing the noise generated by the air compressor 232.

As shown in FIG. 4, one of the air access ports 210 may be positioned at the bottom wall of the air tank 204. During air usage, compressed air being released from the air tank 204, because of its high pressure, may push condensed moisture accumulated in the tank 204 out through the bottom-located air access port 210. The compressed air being released may mix with the discharged condensed moisture and be used in air powered tools. Preferably, the discharged condensate is routed through outlet tubing 252, the manifold assembly 234 and any attached air hose to the air powered tools. Because condensed moisture within the air tank 204 is continuously discharged during air usage, the condensate is discharged in small amounts not harmful to the air powered tools.

In the exemplary embodiment illustrated in FIG. 4, the air tank 204 is enclosed within and supported by the shroud 238. The shroud 238 may also enclose the air compressor 232, the manifold assembly 234, the outlet tubing 252, connecting piping or tubing 254, and electrical wiring. Because the air tank 204 is normally not visible to viewers of the shroud 238 from outside of the assembled shroud, the air tank 204 may be fabricated and assembled into the unit without first being painted. In this manner, processing through an expensive and time consuming paint process is eliminated, thus improving manufacturing efficiencies to lower cost. Moreover, the potentially hot connecting piping or tubing 254 between the air compressor 232 and the air tank 204 is enclosed, thereby reducing the risk of operator burn injuries from hot surfaces. An additional advantage of the enclosed air tank 204 is that the air tank 204 may warm up more quickly than an exposed tank by absorbing heat from the air compressor 232. The air tank 204 also retains heat longer because of reduced convection and radiation cooling to the outside air. By keeping the air tank 204 warmer, the tank is less likely to condense moisture, resulting in reduced tank corrosion.

Figure 5:
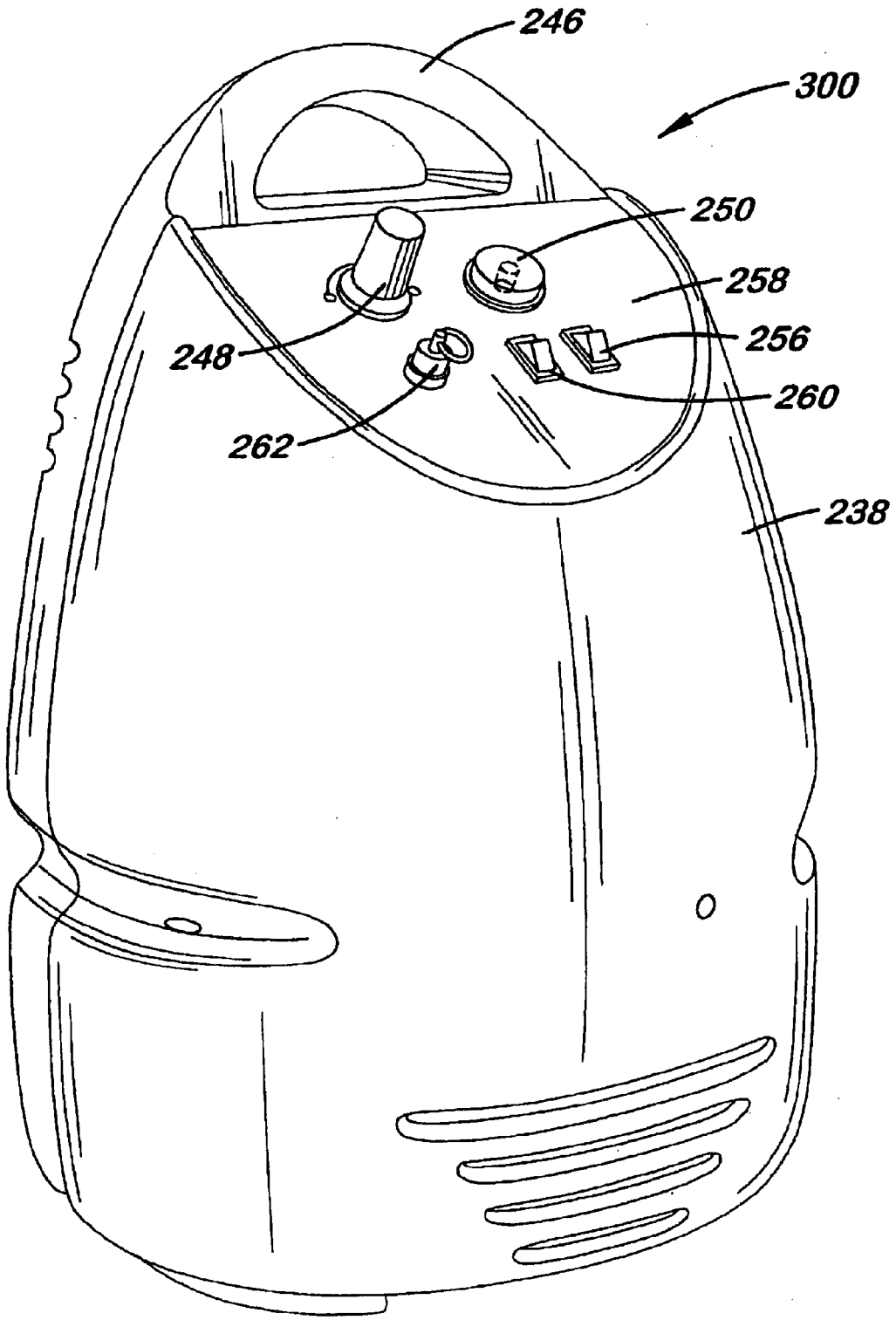
FIG. 5 is an isometric view illustrating an exemplary embodiment of the portable air compressor assembly shown in FIG. 4 that is manufactured in accordance with the present invention.

FIG. 5 is an isometric view illustrating an exemplary embodiment of the portable air compressor assembly 300 shown in FIG. 4, which is manufactured in accordance with the present invention. The portable air compressor assembly 300 may have a control panel 258 which may include an on/off switch 260, a pressure regulator 248, a pressure gauge 250, a pressure relief safety valve 262, and the speed control switch 256. It is understood that the control panel 258 may provide other controls depending on design preferences. As shown in FIGS. 4 and 5, the shroud 238, which is preferably formed of plastic, may include a handle 246, allowing an operator to lift and transport the portable air compressor assembly 300 from place to place.

Referring generally now to FIGS. 6 through 9, an exemplary embodiment of the method 100 applied to manufacturing a portable air compressor assembly 600 (see FIGS. 8 and 9) in accordance with the present invention is shown. As shown in FIG. 6A, a worker 602 such as a human being, a robot, or the like, is welding an air tank 604 of the portable air compressor assembly 600, in accordance with an exemplary embodiment of the welding step 102 illustrated in FIG. 1. The air tank 604 may have a single air access port 610 that is located at an upper wall of the air tank 604. The air access port 610 is an opening that extends through the wall of air tank 604. The air tank 604 may be made of metal such as steel, or the like.

Figure 6A:
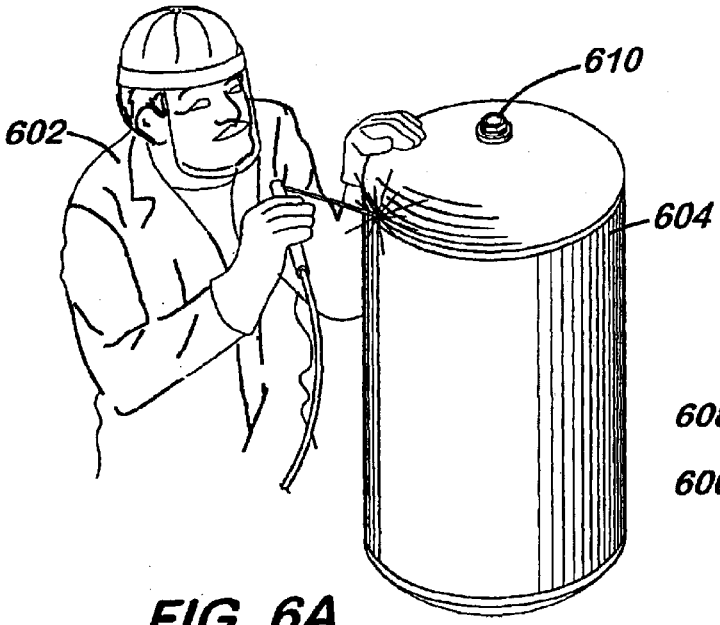
FIG. 6A depicts an additional exemplary embodiment of an air tank of a portable air compressor assembly in a welding step in accordance with an exemplary method of the present invention.
Figure 6B:
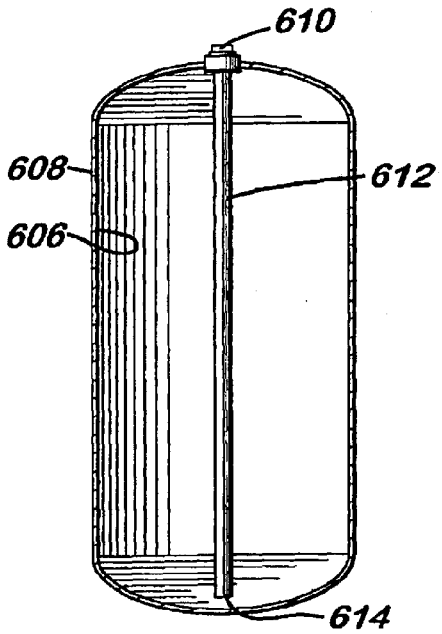
FIG. 6B is a cross-sectional side elevation view illustrating the air tank shown in FIG. 6A.

FIG. 6B is a cross-sectional side elevation view illustrating the air tank 604 shown in FIG. 6A. The air tank 604 has an inside surface 606, an outside surface 608, and the air access port 610. The air access port 610 is also an upper open end of a centrally hollow conduit 612 which is located inside the air tank 604. The conduit 612 protrudes downward from the air access port 610 and has a lower open end 614 positioned in a vicinity of the bottom of the air tank 604. Through the air access port 610 and the conduit 612, during the utilization of the portable air compressor assembly 600, compressed air may be provided to the air tank 604 by an air compressor 632 (not shown in FIG. 6B, but shown in FIG. 8) or taken out of the air tank 604 for use in air powered tools (not shown). The air access port 610 and the conduit 612 may also be used to drain condensed moisture accumulated inside the air tank 604.

Figure 7:
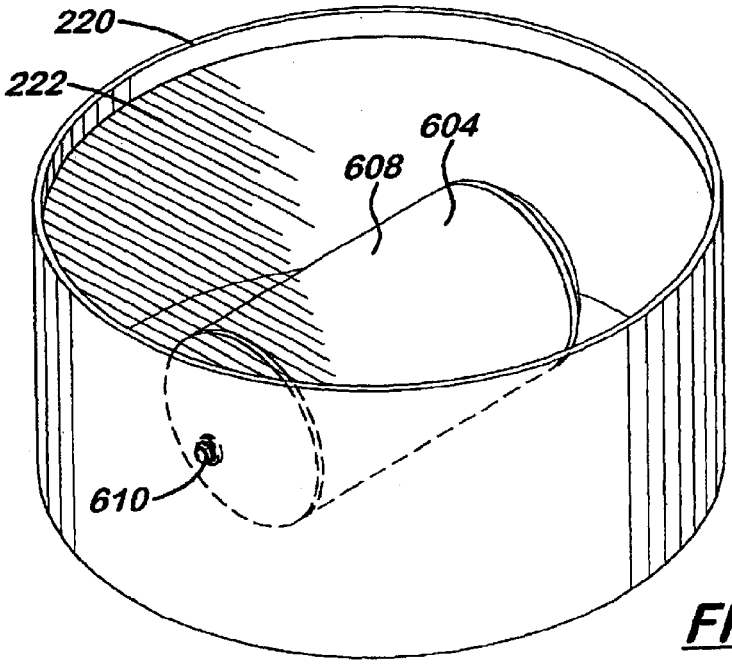
FIG. 7 illustrates the air tank depicted in FIGS. 6A and 6B in a submerging step in accordance with an exemplary method of the present invention.

FIG. 7 depicts an exemplary embodiment of the submerging step 104 illustrated in FIG. 1. After the worker 602 finished the welding step 102, the air tank 604 is submerged into the dip tank 220 filled with the cooling liquid 222 treated with a corrosion inhibitor to cool down and gain corrosion inhibitor protection. The submerging step may be performed in the same cell for the tank welding step. The submerging step may be performed by a human being, a robot, or the like. In one preferred embodiment, the air tank 604 is submerged into the dip tank 220 with its air access port 610 and conduit 612 (not shown) open to allow the cooling liquid 222 to coat both the inside surface 606 and the outside surface 608 to maximize corrosion inhibitor protection and increase tank cooling rate. After the submerging step 102 is finished, the air tank 604 may be air dried and then be ready for final assembly.

Figure 8:
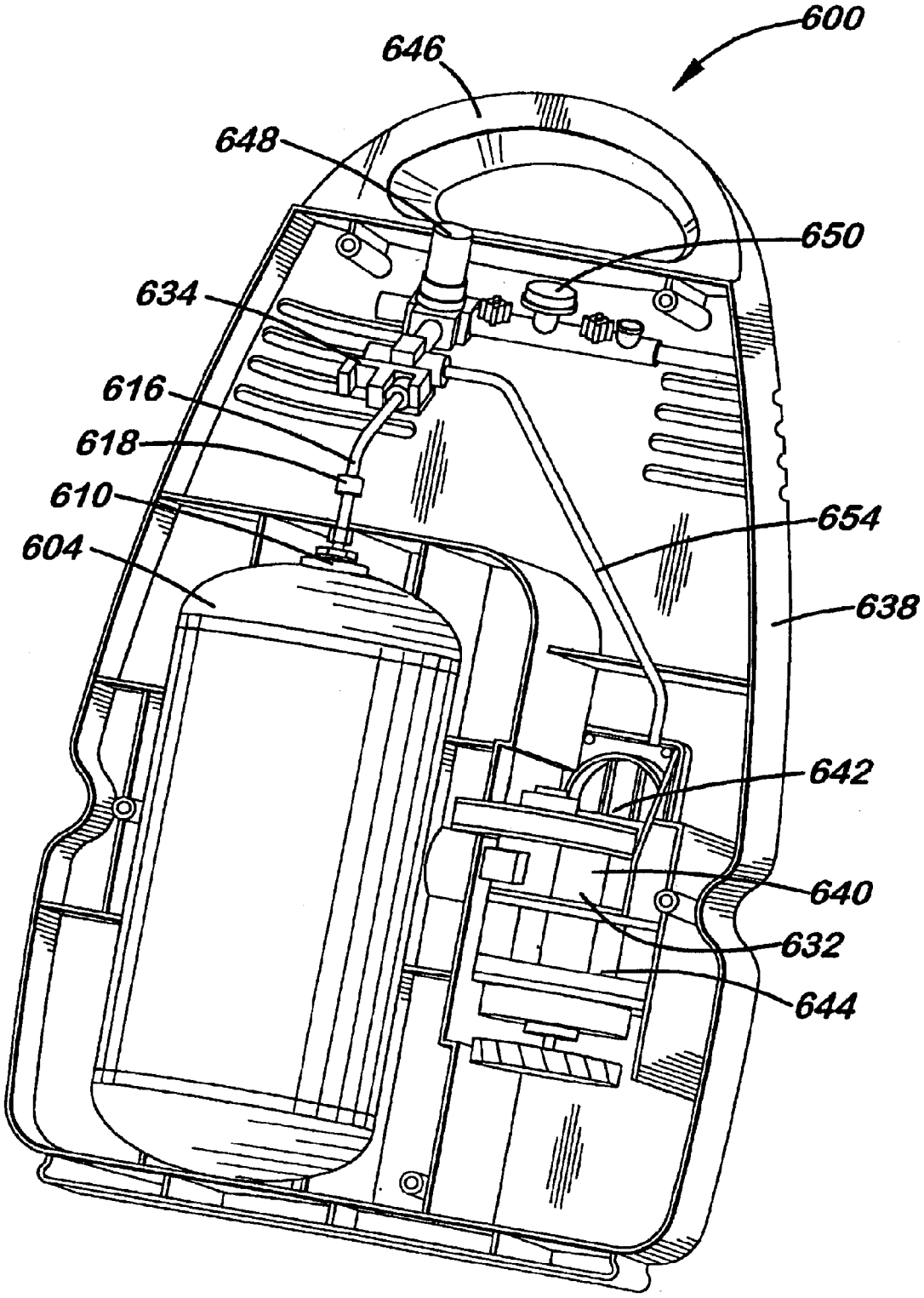
FIG. 8 depicts the air tank shown in FIGS. 6A, 6B and 7 in the portable air compressor assembly in a final assembly step in accordance with an exemplary method of the present invention.

Referring now to FIG. 8, an exemplary embodiment of the final assembly step 106 shown in FIG. 1 is depicted. The portable air compressor assembly 600 may be assembled by a human being and/or a robot (not shown) in the same cell for the welding step and the dip tank. The portable air compressor assembly 600 may include the air tank 604, an air compressor 632, and a manifold assembly 634 assembled within a shroud or housing 638. The air compressor 632 may include a compressor 640 having one or more pistons 642 driven by a motor or engine 644. For example, the air compressor 632 may include a single piston compressor 640 having a single piston driven by a universal electric motor 644. By employing a universal electric motor 644, the speed at which the motor 644 operates, and thus the speed at which the piston 642 is reciprocated, may be varied by controlling the voltage supplied to the motor 644. In this manner, the air flow rate supplied by the air compressor 632 to the air tank 604 may be varied. For example, in the embodiment illustrated in FIG. 9, a speed control switch 656 is provided, which allows an operator to select between a high speed step mode wherein maximum air flow is supplied to the air tank 604 and a low speed operating mode wherein the compressor 640 runs more slowly reducing the noise generated by the air compressor 632.

As described before, the air access port 610 is the upper open end of the conduit 612 (not shown in FIG. 8, but see FIG. 6B). The air access port 610 is often referred to as a "spud" and is connected to a pressure switch assembly 618 which in turn is connected to the manifold assembly 634 via connecting pipe or tubing 616. The pressure switch assembly 618 is used for regulating pressure within the air tank 604 by alternately starting and stopping the air compressor 632 to periodically replenish the supply of air in the tank 604. When pressure within the tank 604 reaches a preset low pressure point, or "kick-in pressure", the pressure switch assembly 618 starts the air compressor 632 to re-pressurize the tank 604. As the pressure within the tank 604 reaches a preset high pressure point, or "kick-out pressure", the pressure switch assembly 618 stops the air compressor 632 to prevent over-pressurization of the tank 604. In this manner, the pressure of the compressed air in the tank 604 is maintained within a range generally suitable for powering one or more air powered tools. During the utilization of the air compressor assembly 600, compressed air being released from the air tank 604, because of its high pressure, pushes condensed moisture accumulated inside the air tank 604 out through the conduit 612 (not shown in FIG. 8, but see FIG. 6B) and the air access port 610. The compressed air being released may mix with the discharged condensed moisture and be used in air powered tools.

Figure 9:
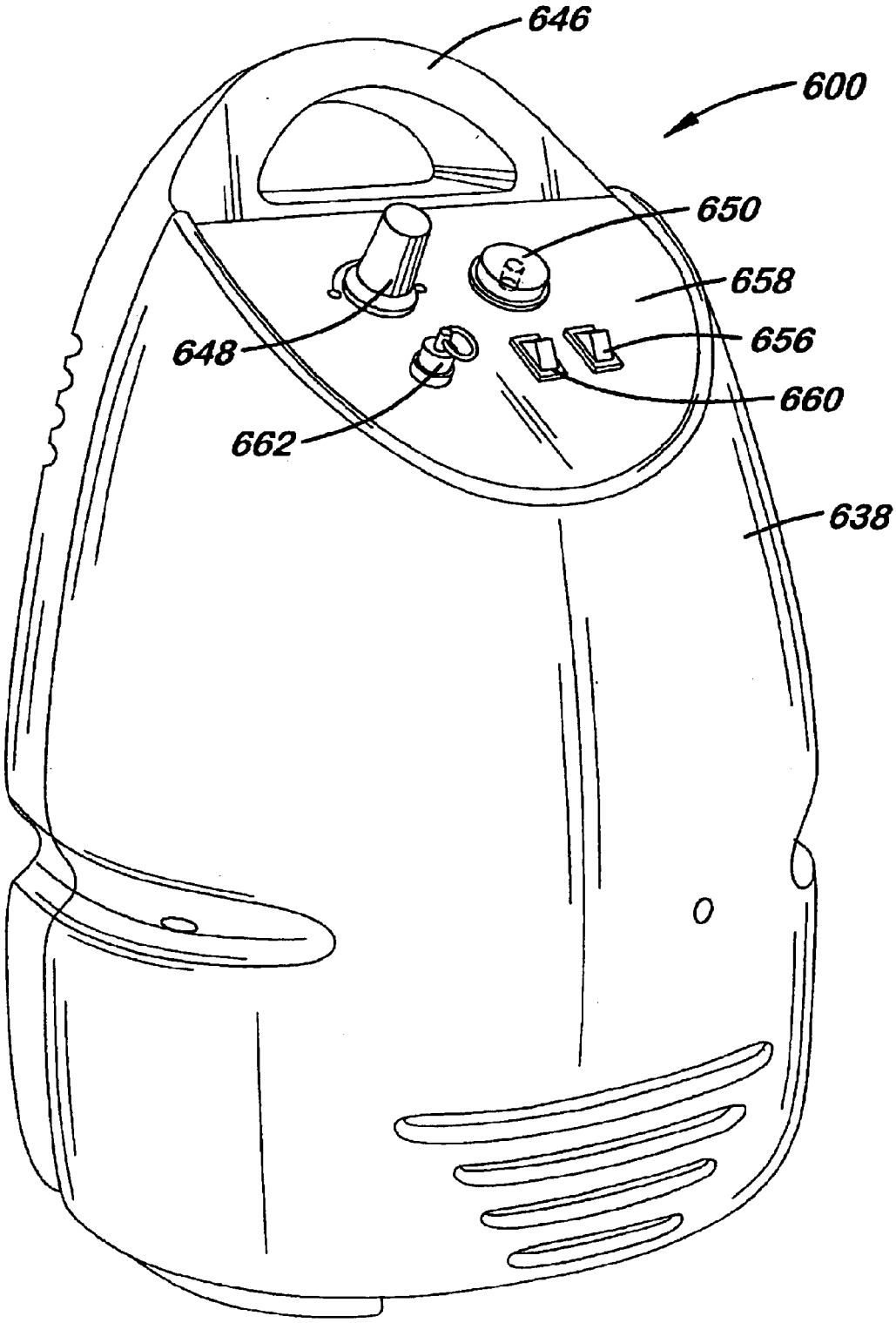
FIG. 9 is an isometric view illustrating an exemplary embodiment of the portable air compressor assembly shown in FIG. 8 that is manufactured in accordance with the present invention.

FIG. 9 is an isometric view illustrating an exemplary embodiment of the portable air compressor assembly 600 shown in FIG. 8, which is manufactured in accordance with the present invention. The portable air compressor assembly 600 may have a control panel 658, which may include an on/off switch 660, a pressure regulator 648, a pressure gauge 650, a pressure relief safety valve 662, and the speed control switch 656. It is understood that the control panel 658 may provide other controls depending on design preferences. As shown in FIGS. 8 and 9, the shroud 638, which is preferably formed of plastic, may include a handle 646, allowing an operator to lift and transport the portable air compressor assembly 600 from place to place.

Those of ordinary skill in the art will understand that the method 100 may be applied to manufacturing other portable air compressor assemblies without departing from the scope and spirit of the present invention. For example, the method 100 may be applied to manufacturing the air compressor assembly 100 shown in FIGS. 6 and 7 of co-pending U.S. patent application ("Express Mail" Mailing Label No. EV 338 284 628 US, filed Jun. 20, 2003). It is understood that a portable air compressor assembly means an air compressor assembly that can be carried and/or moved with ease, and not as a structural limitation.

Figure 10A:
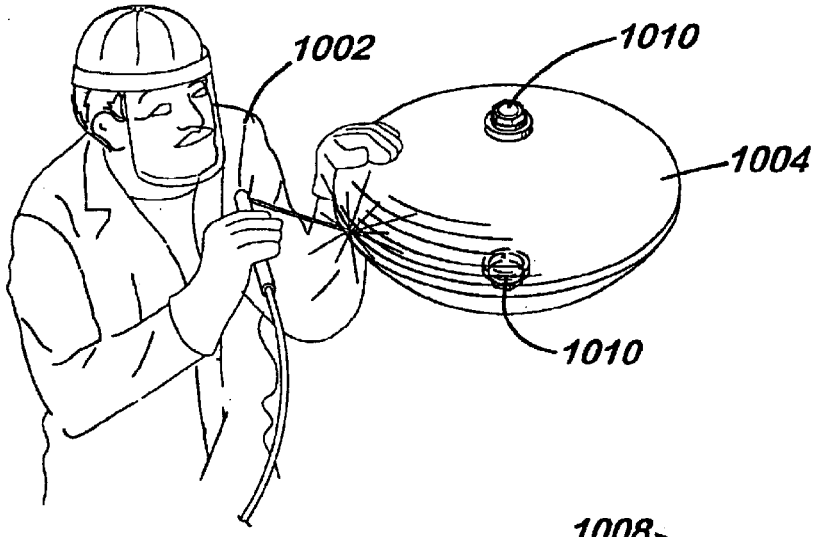
FIG. 10A depicts an exemplary embodiment of an air tank of a "pancake" type air compressor assembly in a welding step in accordance with an exemplary method of the present invention.
Figure 10B:
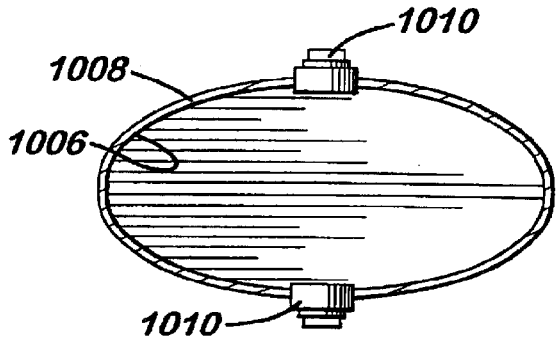
FIG. 10B is a cross-sectional side elevation view illustrating the air tank shown in FIG. 10A.
Figure 11:
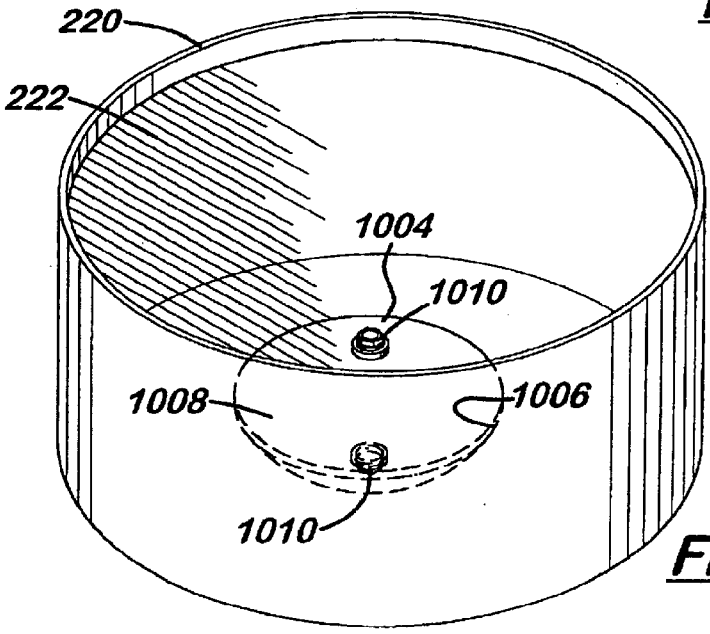
FIG. 11 illustrates the air tank depicted in FIGS. 10A and 10B in a submerging step in accordance with an exemplary method of the present invention.
Figure 12:
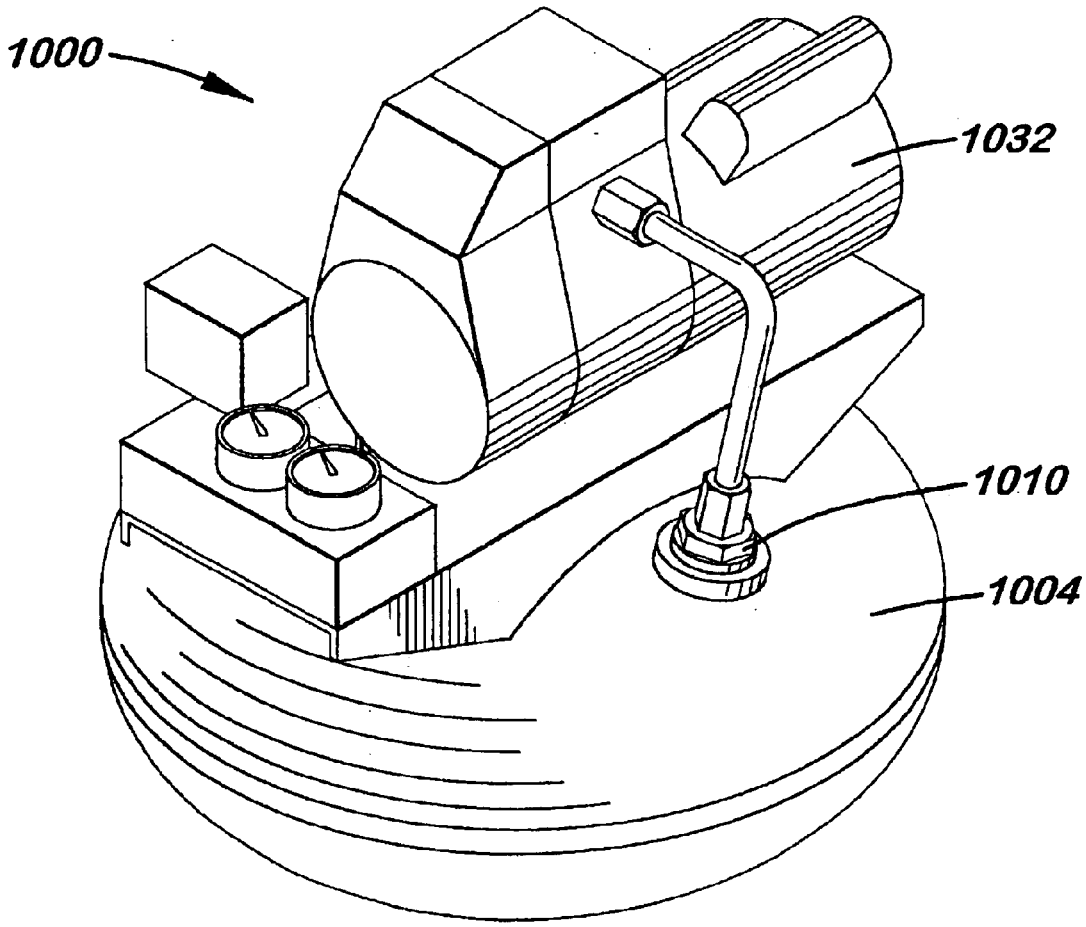
FIG. 12 is an isometric view illustrating an exemplary embodiment of the "pancake" type air compressor assembly manufactured in accordance with the present invention.

Referring generally now to FIGS. 10 through 12, an exemplary embodiment of the method 100 applied to manufacturing a "pancake" type air compressor assembly 1000 (see FIG. 12) in accordance with the present invention is shown. As shown in FIG. 10A, a worker 1002 such as a human being, a robot, or the like, is welding an air tank 1004 of the "pancake" type air compressor assembly 1000, in accordance with an exemplary embodiment of the welding step 102 illustrated in FIG. 1. The air tank 1004 is a flattened oval tank, often referred to informally in the art as a "pancake" style tank. The tank 1004 may have two air access ports 1010 located at the tank wall. The air access ports 1010 are openings that extend through the tank wall. The air tank 1004 may be made of metal such as steel, or the like.

FIG. 10B is a cross-sectional side elevation view illustrating the air tank 1004 shown in FIG. 10A. The air tank 1004 has an inside surface 1006, an outside surface 1008, and the air access ports 1010. Through the air access ports 1010, during the utilization of the "pancake" type air compressor assembly 1000, compressed air may be provided to the air tank 1004 by an air compressor 1032 (not shown in FIG. 10B, but see FIG. 12) or taken out of the air tank 1004 for use in air powered tools (not shown). The air access ports 1010 may also be connected to a drain valve (not shown) to drain condensed moisture accumulated inside the air tank 1004 by periodically opening the drain valve.

FIG. 11 depicts an exemplary embodiment of the submerging step 104 illustrated in FIG. 1. After the worker 1002 finished the welding step 102, the air tank 1004 is submerged into the dip tank 220 filled with the cooling liquid 222 treated with a corrosion inhibitor to cool down and gain corrosion inhibitor protection. The submerging step may be performed in the same cell for the tank welding step. The submerging step may be performed by a human being, a robot, or the like. In one preferred embodiment, the air tank 1004 is submerged into the dip tank 220 with its air access ports 1010 open to allow the cooling liquid 222 to coat both the inside surface 1006 and the outside surface 1008 to maximize corrosion inhibitor protection and increase tank cooling rate. After the submerging step 102 is finished, the air tank 1004 may be air dried and then be ready for finally assembly.

FIG. 12 illustrates an exemplary embodiment of the "pancake" type air compressor assembly 1000 that is manufactured in accordance with the present invention after the final assembly.

Figure 13A:
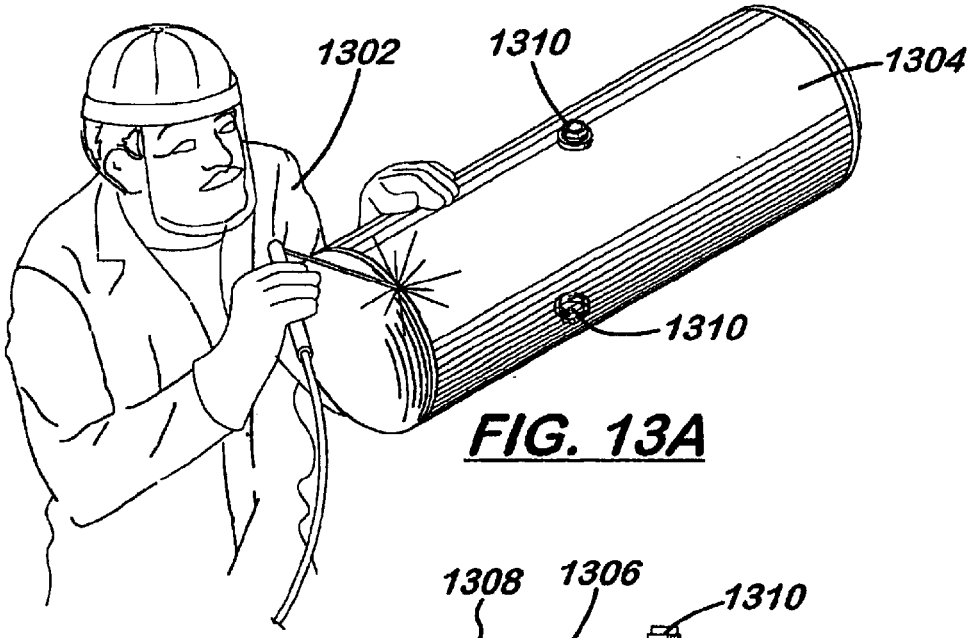
FIG. 13A depicts an exemplary embodiment of an air tank of a "hot-dog" type air compressor assembly in a welding step in accordance with an exemplary method of the present invention.
Figure 13B:
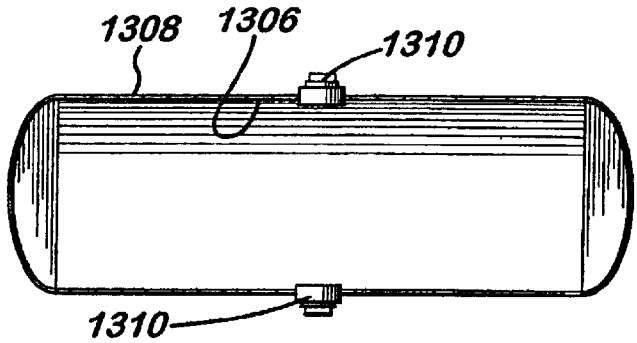
FIG. 13B is a cross-sectional side elevation view illustrating the air tank shown in FIG. 13A.
Figure 14:
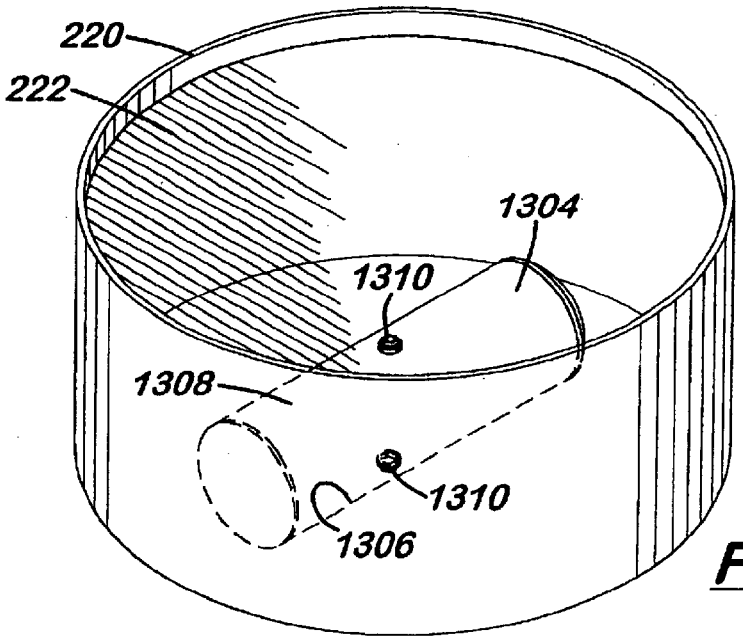
FIG. 14 illustrates the air tank depicted in FIGS. 13A and 13B in a submerging step in accordance with an exemplary method of the present invention.
Figure 15:
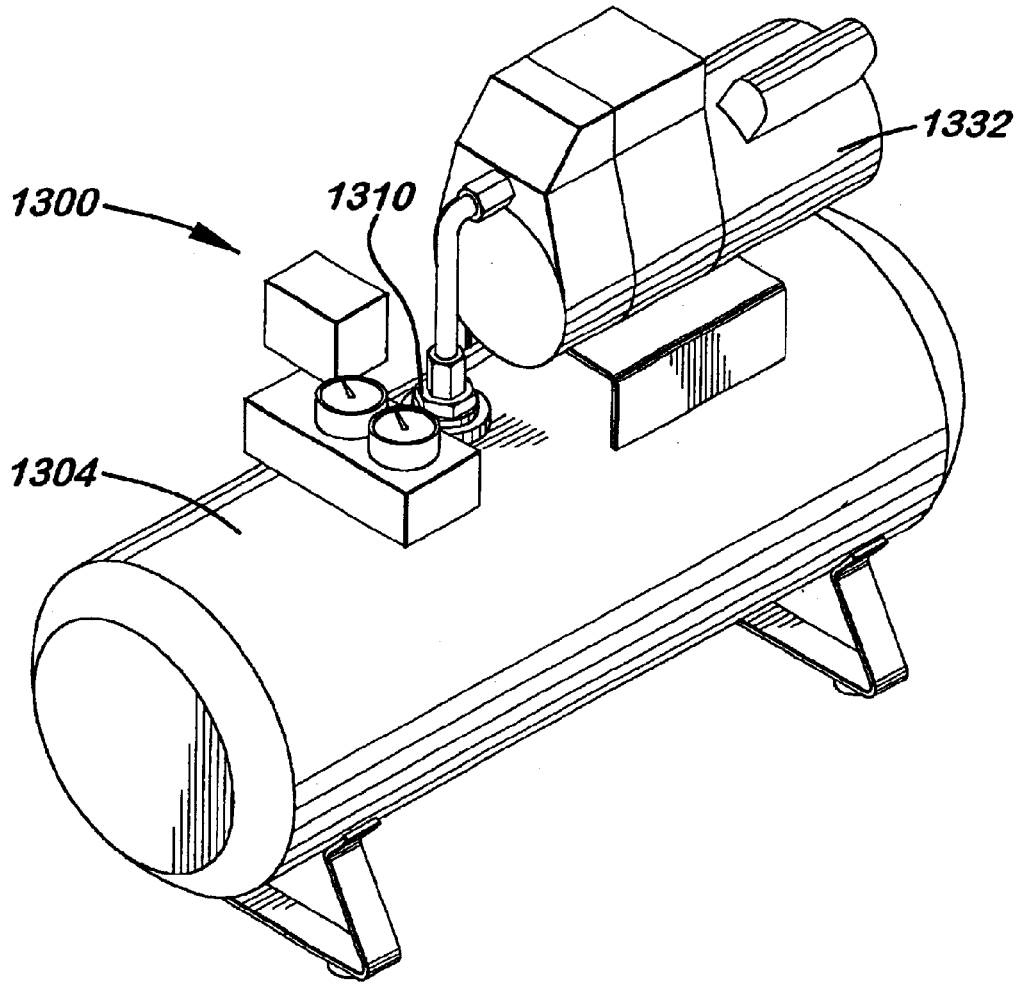
FIG. 15 is an isometric view illustrating an exemplary embodiment of the "hot-dog" type air compressor assembly manufactured in accordance with the present invention.

Referring generally now to FIGS. 13 through 15, an exemplary embodiment of the method 100 applied to manufacturing a "hot-dog" type air compressor assembly 1300 (see FIG. 15) in accordance with the present invention is shown. As shown in FIG. 13A, a worker 1302 such as a human being, a robot, or the like, is welding an air tank 1304 of the "hot-dog" type air compressor assembly 1300, in accordance with an exemplary embodiment of the welding step 102 illustrated in FIG. 1. The air tank 1304 is a single horizontally disposed, cylindrical compressed air storage tank, typically referred to informally in the art as a "hot-dog" type tank. The tank 1304 may have two air access ports 1310 located at the tank wall and may be made of metal such as steel, or the like. The air access ports 1310 are openings that extend through the tank wall.

FIG. 13B is a cross-sectional side elevation view illustrating the air tank 1304 shown in FIG. 13A. The air tank 1304 has an inside surface 1306, an outside surface 1308, and the air access ports 1310. Through the air access ports 1310, during the utilization of the "hot-dog" type air compressor assembly 1300, compressed air may be provided to the air tank 1304 by an air compressor 1332 (not shown in FIG. 13B, but see FIG. 15) or taken out of the air tank 1304 for use in air powered tools (not shown). The air access ports 1310 may also be connected to a drain valve (not shown) to drain condensed moisture accumulated inside the air tank 1304 by periodically opening the drain valve.

FIG. 14 depicts an exemplary embodiment of the submerging step 102 illustrated in FIG. 1. After the worker 1302 finished the welding step 102, the air tank 1304 is submerged into the dip tank 220 filled with the cooling liquid 222 treated with a corrosion inhibitor to cool down and gain corrosion inhibitor protection. The submerging step may be performed in the same cell for the tank welding step. The submerging step may be performed by a human being, a robot, or the like. In one preferred embodiment, the air tank 1304 is submerged into the dip tank 220 with its air access ports 1310 open to allow the cooling liquid 222 to coat both the inside surface 1306 and the outside surface 1308 to maximize corrosion inhibitor protection and increase tank cooling rate. After the submerging step 102 is finished, the air tank 1304 may be air dried and then be ready for finally assembly.

FIG. 15 illustrates an exemplary embodiment of the "hot-dog" type air compressor assembly 1300 that is manufactured in accordance with the present invention after the final assembly.

It is understood that the air compressor assemblies shown in FIGS. 2 through 15, which are manufactured in accordance with the present invention, are exemplary and not meant to limit the scope of the present invention. Those of ordinary skill in the air understand that the method of the present invention may be used to manufacture air compressor assemblies in various styles. For example, the method of the present invention may be used to manufacture a portable air compressor assembly wherein the air tank is connected to a drain valve through one of its air access ports, a vertical "hot-dog" type air compressor assembly, a "double hot-dog" type air compressor assembly, a vertical stationary air compressor assembly, and the like. It is understood that the method of the present invention applies to manufacturing air compressor assemblies having an air tank with one, two, or more air access ports.

It is also understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention of a method for manufacturing an air compressor assembly and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for manufacturing an air compressor assembly, comprising:

welding an air tank, the air tank having at least one air access port formed therein;

submerging the air tank into a dip tank containing cooling liquid; and assembling the air tank into an air compressor assembly.

2. The method according to claim 1, wherein the cooling liquid is treated with a corrosion inhibitor.

3. The method according to claim 2, wherein the cooling liquid is cooling water.

4. The method according to claim 3, wherein the submerging step further comprises opening the at least one air access port of the air tank to allow the cooling water to coat both inside and outside surfaces of the air tank.

5. The method according to claim 1, wherein the welding step, the submerging step, and the assembling step are performed in a single manufacturing cell.

6. The method according to claim 1, wherein the air tank is made of metal.

7. The method according to claim 6, wherein the air tank is made of steel.

8. The method according to claim 1, wherein the air compressor assembly is of a portable type.

9. The method according to claim 1, wherein the air compressor assembly is of a "pancake" type.

10. The method according to claim 1, wherein the air compressor assembly is of a "hot-dog" type.

11. The method according to claim 1, wherein the air compressor assembly is of a vertical "hot-dog" type.

12. The method according to claim 1, wherein the air compressor assembly is of a "double hot-dog" type.

13. The method according to claim 1, wherein the air compressor assembly is of a vertical stationary type.

14. A method for manufacturing a portable air compressor assembly, comprising:

welding an air tank, the air tank having at least one air access port formed therein;

submerging the air tank into a dip tank containing cooling liquid treated with a corrosion inhibitor; and assembling the air tank into a portable air compressor assembly.

15. The method according to claim 14, wherein the air tank is made of metal.

16. The method according to claim 15, wherein the air tank is made of steel.

17. The method according to claim 14, wherein the submerging step further comprises opening the at least one air access port of the air tank to allow the cooling liquid to coat both inside and outside surfaces of the air tank.

18. The method according to claim 14, wherein the welding step, the submerging step, and the assembling step are performed in a single manufacturing cell.

19. The method according to claim 14, wherein the cooling liquid is cooling water.

* * * * *